United States Patent [19]

Boudreau

[11] 4,226,467

[45] Oct. 7, 1980

[54] FOLDABLE CANTILEVERED PLAYSEAT

[75] Inventor: Robert J. Boudreau, Bedford, Pa.

[73] Assignee: Hedstrom Co., Bedford, Pa.

[21] Appl. No.: 59,895

[22] Filed: Jul. 23, 1979

[51] Int. Cl.[2] ..... A47D 13/04

[52] U.S. Cl. ..... 297/5; 248/594; 297/16; 272/55

[58] Field of Search ..... 297/5, 6, 16, 274, 282; 248/585, 587, 594, 592; 272/55, 70.3; 280/87.02 W

[56] References Cited

U.S. PATENT DOCUMENTS

| | | | |
|---|---|---|---|
| 1,297,018 | 3/1919 | Scott | 272/55 |
| 2,927,628 | 3/1960 | Gill | 248/585 |
| 3,007,667 | 11/1961 | Rossi | 248/585 |
| 3,009,733 | 11/1961 | Gelman | 297/5 |
| 3,066,906 | 12/1962 | Berlin | 297/274 X |
| 3,172,696 | 3/1965 | DeVos | 297/16 |
| 4,045,045 | 8/1977 | Boucher | 297/5 |

*Primary Examiner*—Francis K. Zugel
*Attorney, Agent, or Firm*—Cesari and McKenna

[57] ABSTRACT

A foldable cantilevered playseat has a base and a generally U-shaped seat-supporting member whose ends are pivotally connected to the base. Telescoping resiliently biased struts pivotally connected between the frame member legs and the bight of a bail swingably connected to the base resiliently bias the seat-supporting frame member above the base. A fabric seat supported by the frame member is arranged to support a child so that his feet can engage the floor below the base.

7 Claims, 9 Drawing Figures

FIG. 1
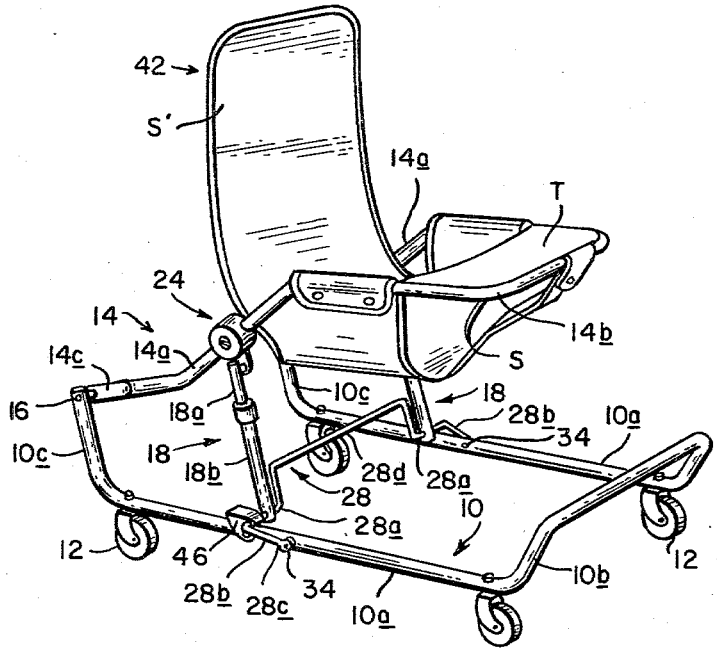
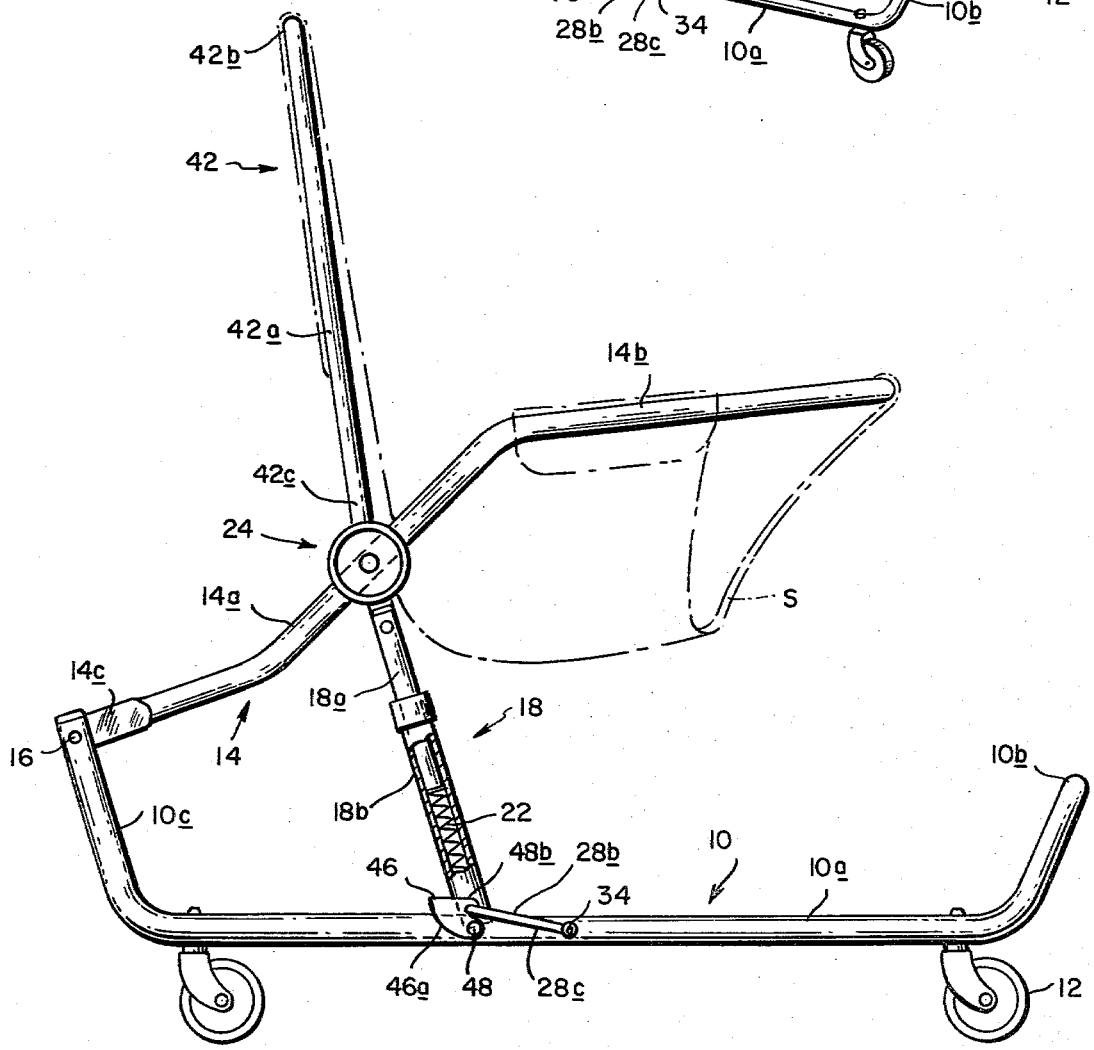
FIG. 2

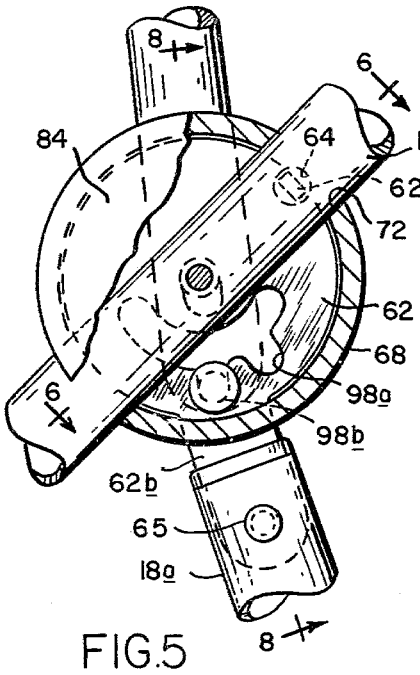
FIG.5
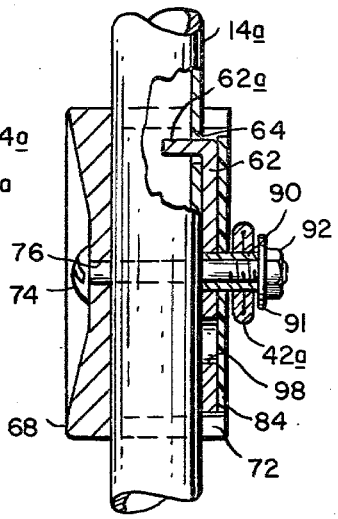
FIG.6
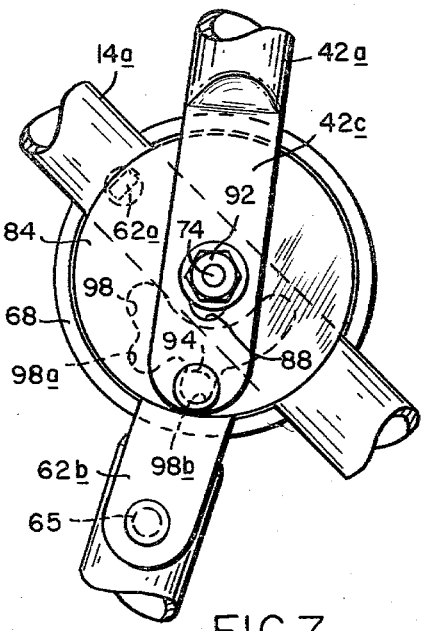
FIG.7
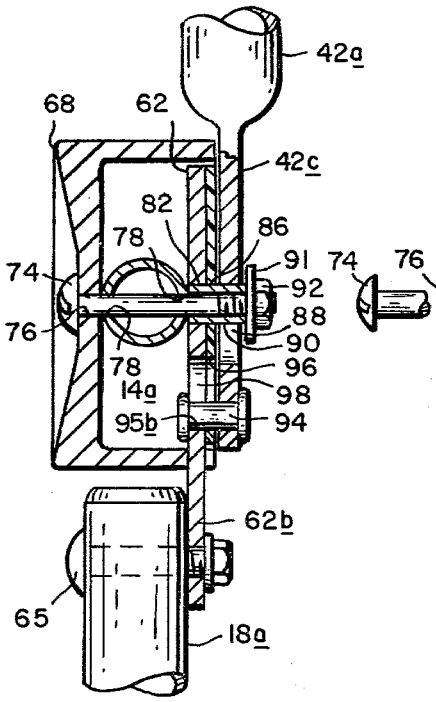
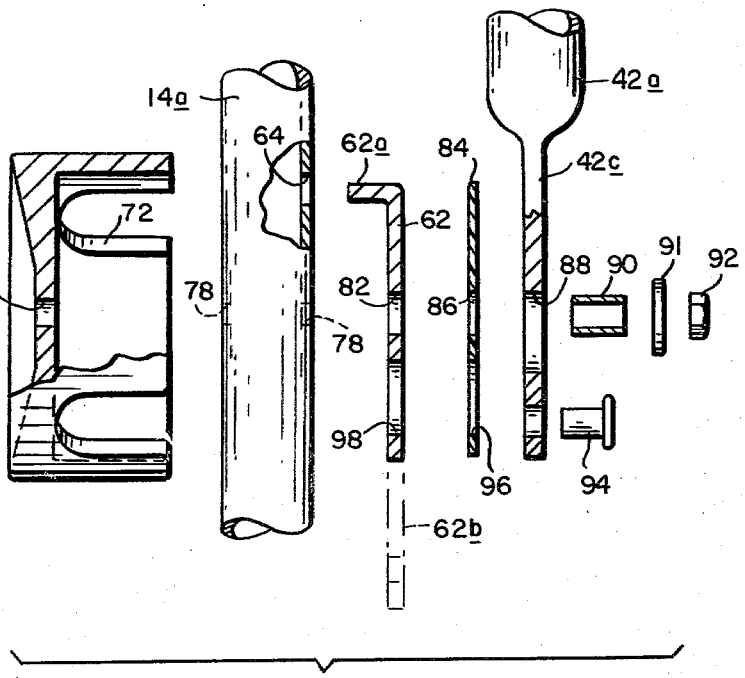
FIG.9
FIG.8

FOLDABLE CANTILEVERED PLAYSEAT

This invention relates to a child's playseat. It relates more particularly to a child's cantilevered bouncer and walker of the foldable variety.

BACKGROUND OF THE INVENTION

Usually a cantilevered playseat includes a base which rests on the floor and a seat which is supported above the base by parallel inclined arms at each side of the base which are pivoted to the base and to the seat. The arms are spring biased so as to tend to maintain the seat in a generally horizontal orientation above the base. However, when a child exerts weight on the seat or bounces up and down in the seat, the arms pivot relative to the base and the seat in such a way as to permit the seat to swing up and down relative to the base while maintaining its horizontal orientation. Usually provision is also made for releasing the spring so that the arms and the seat can fold down against the base with the folded playseat forming a relatively compact package for efficient storage.

Conventional playseats of the cantilevered type have various drawbacks which militate against their wider use. Some are composed of a relatively large number of parts and linkages. Others have pinch points which could cause injury to a child playing in the seat. In some cantilevered bouncers and walkers the folding mechanism can be released accidentally by a child sitting in the playseat causing collapse of the seat which could cause injury to the child. Finally, most foldable cantilevered seats resiliently bias the seat above the base by extensible coil springs. If the springs should break or their connections to the playseat frame should part, the seat supporting the child collapses to the floor, again with possible injurious consequences. Examples of such prior playseats of this general type are described in U.S. Pat. Nos. 2,927,628, 2,976,911, 3,007,667, 3,054,591, 3,061,261, 3,076,628, and 3,096,963.

SUMMARY OF THE INVENTION

Accordingly, the present invention aims to provide an improved foldable walker and bouncer of the cantilevered type.

Another object is to provide a playseat of this general type which folds easily into a relatively compact package.

A further object of the invention is to provide a cantilevered playseat which has no pinch points which are accessible to a child sitting in the seat.

A further object of the invention is to provide a cantilevered playseat which is composed of relatively few parts and linkages.

Yet another object of the invention is to provide a resilient cantilevered playseat which does not drop the occupant to the floor when its springs fail.

Still another object of the invention is to provide a cantilevered playseat which is relatively economical to manufacture.

Other objects will, in part, be obvious and will, in part, appear hereinafter.

The invention accordingly comprises the principles of construction, combination of elements and arrangement of parts which will be exemplified in the following detailed description, and the scope of the invention will be indicated in the claims.

Briefly, my playseat comprises a horizontal, generally U-shaped base provided with casters which are arranged to roll on the floor or ground. The ends of the legs of the base are turned upwards. A generally U-shaped seat-supporting frame member is juxtaposed with the base frame member, the ends of its legs being pivotally connected to the upturned ends of that base frame member. Pivotally connected to each leg of the seat-supporting frame member is one end of a telescoping strut whose opposite end is pivotally connected to the bight of a bail whose opposite ends are, in turn, pivotally connected to the base. Normally the bail is maintained in an overcenter position on the base so that it supports the struts in more or less upstanding positions. Also, each strut is spring-loaded toward its extended position so that the struts together maintain the seat-supporting frame member in an inclined elevated orientation above the base frame member. A generally U-shaped back frame member has the opposite ends of its legs pivotally connected to the legs of the seat-supporting member at more or less the same location as the pivotal connections of that latter member to the struts. Means are provided for selectively locking the back frame member at selective angular positions relative to the seat-supporting member so the occupant of the playseat can be supported in an upright or reclined position. A conventional bag seat is suspended from the back frame member and the seat-supporting member for supporting a child and, if desired, a tray may be supported at the forward end of the seat-supporting frame member to contain articles for amusing the occupant of the playseat.

When the playseat is in its erect position as aforesaid, the seat-supporting frame member and the bag seat and the occupant thereof are resiliently supported above the base. Therefore, the occupant of the seat by placing his feet on the floor below the base can bounce the seat up and down or walk the playseat along the floor with his feet. Since the seat is supported in its erect position by compression spring-loaded telescoping struts, there is no possibility of the springs breaking and causing the seat to collapse to the floor. Even if the compression springs in the struts should be completely compressed, the seat and its occupant are still positioned a considerable distance above the base.

As will be described in detail later, special protective covers are provided at the pivotal connections between the struts and the base frame member and the back frame member so that there are no pinch points within reach of the occupant of the playseat that could cause injury to the his fingers.

The seat is folded to its collapsed position by swinging the bail supporting the lower ends of the struts about its pivots to the base. This shifts the lower ends of the struts forwardly by a sufficient amount to permit the seat-supporting frame member to swing down against the base. Such folding cannot occur when the seat is occupied because the weight of the occupant exerted through the struts prevents the bail from being swung from its normal overcenter position. Also as an added safety measure a latch, inaccessible to the child, is provided to positively lock the bail in its normal position. The back frame member can be manipulated so that it can be swung about its pivots to the seat supporting member down against the base so that the folded playseat as a whole occupies a relatively small amount of space.

Thus my playseat which functions both as a bouncer and as a walker is composed of a relatively few formed metal parts so that it is relatively easy and inexpensive to manufacture. The playseat is also a relatively safe item of juvenile furniture in that there is no possibility of the seat collapsing in the event of the breakage of a spring. Moreover, there is little likelihood of the occupant of the seat being able to manipulate the folding mechanism so as to permit the seat to collapse when the child is in the seat. Accordingly, it should prove to be a successful item of juvenile furniture.

BRIEF DESCRIPTION OF THE DRAWING

For a fuller understanding of the nature and objects of the invention, reference should be had to the following detailed description taken in connection with the accompanying drawing, in which:

FIG. 1 is a perspective view of a playseat made in accordance with this invention;

FIG. 2 is a side elevational view on a larger scale showing the playseat as erected in greater detail;

FIG. 5 is a side elevational view on a larger scale with parts broken away showing the pivot assembly portion of the FIG. 1 playseat in greater detail;

FIG. 6 is a sectional view along line 6—6 of FIG. 5;

FIG. 7 is a view similar to FIG. 5 showing the opposite side of that assembly;

FIG. 8 is a sectional view along line 8—8 of FIG. 5, and

FIG. 9 is an exploded view showing the various pivot assembly parts.

DESCRIPTION OF THE PREFERRED EMBODIMENT

Figure 3:
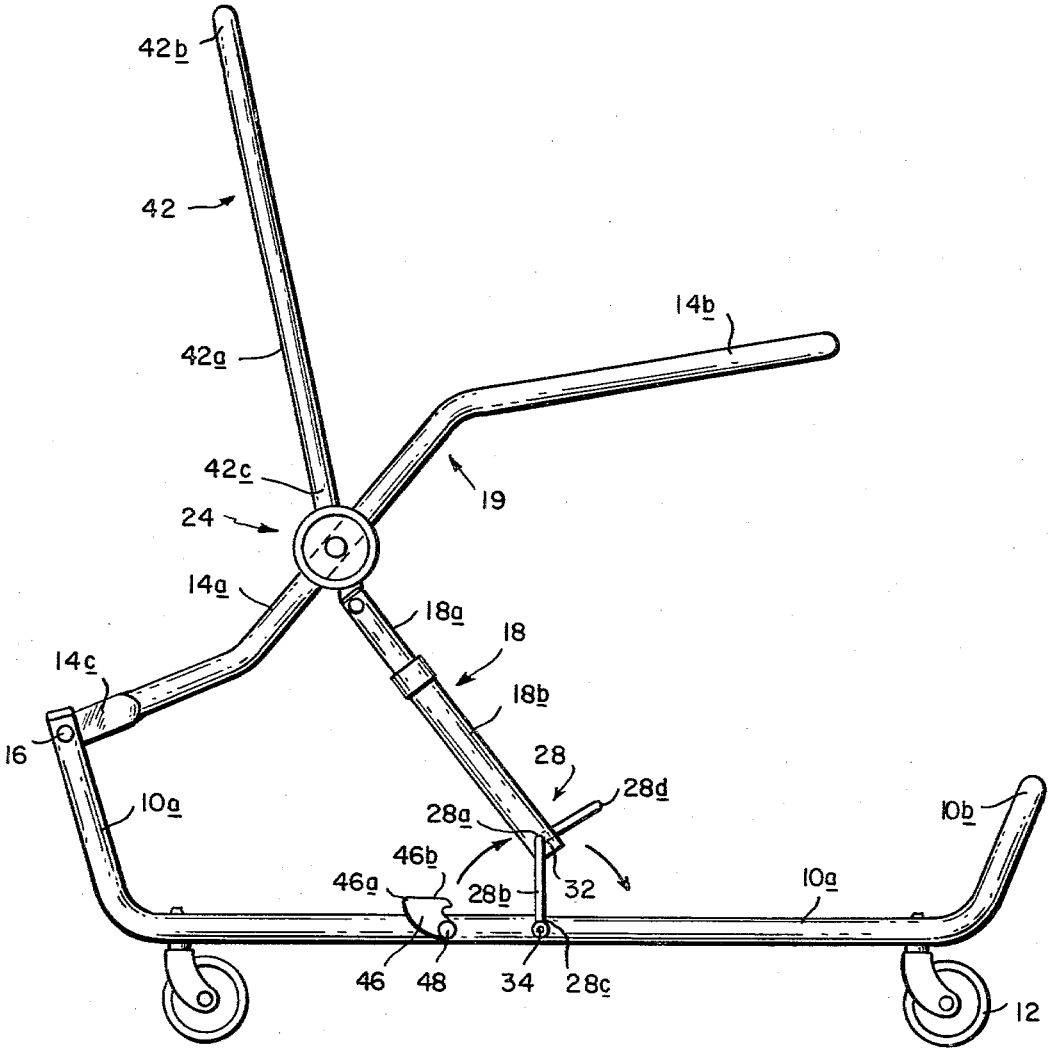
FIG. 3 is a similar view showing the playseat in its partially folded condition.

Referring to FIGS. 1 to 3 of the drawing, my playseat is supported above the floor or ground by a generally U-shaped base frame member shown generally at 10 having a pair of legs 10*a* connected by an upturned bight 10*b*. The leg ends 10*c* are also turned upwards. Conventional casters 12 are pivotally connected near the opposite ends of the legs 10*a* so that the base frame member can be rolled along the ground. A generally U-shaped seat-supporting frame member indicated generally at 14 has opposite side legs 14*a* connected by a bight 14*b*. The end 14*c* of each leg is connected by pivots 16 to the upturned end 10*c* of the base frame member.

The seat-supporting frame member 14 is supported at an inclined elevated position above the base frame member 10 by a pair of telescoping struts shown generally at 18. Each strut includes an upper section 18*a* and a lower section 18*b* which are urged toward their extended position by a coiled compression spring 22 (FIG. 2) inside section 18*b*. The upper end of the strut section 18*a* is connected by a special pivot shown generally at 24 to be described in detail later to a frame member leg 14*a* about a third of the way along that leg from its end 14*c*. The lower end of each strut section 18*b* is pivotally connected to a generally U-shaped bail shown generally at 28 which is, in turn, pivotally connected to the legs 10*a* of the base frame member 10.

More particularly, the lower ends of the strut sections 18*b* are provided with lateral openings 32 (FIG. 3) which rotatively receive the bight 28*a* of the bail 28 near opposite ends of the bail just inboard of the base frame member legs 10*a*. The legs 28*b* of the bail, on the other hand, are bent forwardly generally parallel to the legs 10*a* and their ends 28*c* are connected by pivots 34 to the legs 10*a*. Thus when the seat is in its erect position shown in FIGS. 1 and 2, the opposite ends of the bail bight 28*a* extend across and engage the base frame member legs 10*a* so as to maintain the bail in an overcentered position rotatively supporting the lower ends of the struts more or less even with the plane of the base frame member. Preferably also, the mid-portion 28*d* of the bail bight inboard of the struts 18 is bent upwardly as best seen in FIG. 1 so as to prevent the lower ends of the struts from toeing in toward the center of the playseat.

The playseat also includes a generally U-shaped back frame member indicated generally at 42 having a pair of parallel arms 42*a* connected at their tops by a bight 42*b*. The lower ends 42*c* of the legs are adjustably pivotally connected to the pivots 24 in a manner to be described later permitting the back frame member to assume various orientations relative to the seat frame member so as to support the occupant of the playseat in different positions.

A standard bag seat S is removably secured to the seat-supporting frame member 14. To facilitate this, the foward ends of the legs 14*a* are bent so that they are oriented generally parallel to the base frame member legs 10*a* when the seat is in its erect position illustrated in FIGS. 1 and 2. The seat S also includes a back portion S′ which removably engages over the top of the back frame member 42 so that the seat S completely supports an infant or small child sitting in the seat. Also a standard tray T can be removably secured at the forward end of the seat-supporting frame member 14 to contain toys for the child using the seat.

It is a feature of my playseat that there are no weak linkages whose parting could cause the seat to collapse. More particularly and still referring to FIG. 2, the bottom ends of struts 18 are positively supported by the bail 28 which positively engages the tops of the base frame member legs 10*a* just adjacent the strut ends. The upper ends of the struts are located directly under the pivots 24 which can function as positive stops for the struts. Resultantly, even if a considerable downward force is applied by the child to the playseat, substantially all of that load is directly downward and is reflected in compression of the struts 18 rather than any extension or bending of a link. Therefore the playseat is very strong and safe.

It should be noted also that when the playseat is occupied, the weight of the occupant pushes the struts 18 downward so that the over center bail 28 is urged even more firmly against the base frame member legs 10*a*. Also most preferably, one or more spring-loaded latches are provided to lock the bail bight 28*a* positively against the base frame member. One such latch is illustrated generally at 46 in FIG. 1. It comprises a pair of depending legs 46*a* which straddle the base frame member leg 10*a*. Those legs are connected by a pivot 48 to the leg and the latch includes a nose 48*b* which engages over the bail bight 28*a*. A spring (not shown) biases the latch toward that engaging position. Thus in order to move the bail, the latch 46 first has to be retracted from the bail.

Figure 4:
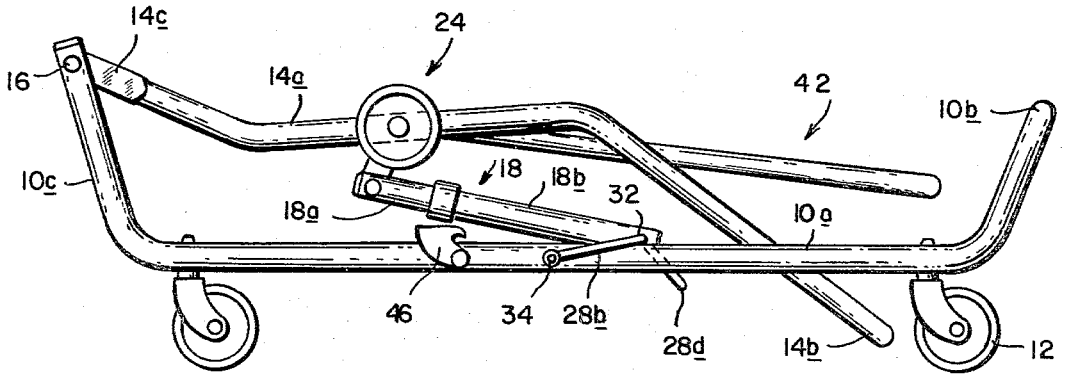
FIG. 4 is a similar view showing the playseat fully folded.

The seat is folded for storage by depressing latch 46 so as to disengage it from the bail and then swinging the bail 28 forwardly about its pivot 34 through the position shown in FIG. 3. This motion moves the lower ends of the struts 18 forward sufficiently to permit the seat-supporting frame member 14 to swing down against the base frame member 10 as shown in FIG. 4. Then the back frame member 42 can be releasably swung forwardly so that it lies substantially flush against the top of seat-supporting frame member 14 as seen in that same figure. Consequently, the folded playseat forms a very compact package.

Referring now to FIGS. 5 to 9, each pivot 24 includes a relatively heavy round metal disk 62 which engages against the inside of a seat-supporting frame member leg 14*a*. The disk has a laterally extending lug 62*a* which projects through an opening 64 in that leg. Also the disk has a tongue 62*b* which extends downward when the playseat is in its erect position as shown in FIGS. 1 and 2. This tongue is connected by a pivot 65 to the upper end of the strut section 18*a*. A cup-shaped decorative plastic cap 68 is engaged over the frame member leg 14*a*, suitable openings 72 being provided at diametrically opposite points at the sides of the cap 68 to accommodate the leg.

A screw 74 extends through a central opening 76 in cap 68 and through aligned openings 78 in the walls of leg 14*a* and thence through a central opening 82 in disk 62. Inboard of disk 62 is a circular plastic disk 84 having a central opening 86 which also receives screw 74. The cap 68 is shaped and arranged so that its rim is more or less flush with the plastic disk 84 so that the plastic disk and cap completely enclose the metal disk 62. After passing through disk 84, the screw 74 extends through a centrally located slot 88 in the flattened end 42*c* of the back frame member leg 42*a*. A sleeve 90 and a washer 91 best seen in FIG. 9 are slid onto the screw at legend 42*c*. Finally, all of the aforesaid components are clamped together by a nut 92 turned down onto the end of the screw 74.

A lug 94 projects laterally from each leg end 42*c* through a slot 96 in the plastic disk 84 and into an arcuate slot 98 in disk 62. Thus when the back frame member 42 is swung about its pivot screws 74, the lugs 94 on its legs ride in the corresponding slots 98. A pair of notches 98*a* and 98*b* are formed in the lower edge of slot 98. The slots 88 in the frame member ends 42*c* permit those ends to move vertically so that when the lugs 94 are aligned with one or another of the notches 98*a*, 98*b*, the lugs engage in the notches to lock the back frame member in place. Those notches are positioned so that such engagements occur when the back frame member is more or less upright and when the back rest member is in a more reclined position. Of course, additional notches may be provided to set a variety of different inclinations of the back frame member to support the playseat occupant in different reclining positions.

It will be seen from the foregoing, then, that the playseat made in accordance with this invention is composed of a relatively few parts so that it is relatively inexpensive to manufacture. When the seat is in its erect position, a child in the seat can bounce up and down and walk about without any likelihood of the playseat collapsing due to breakage of the seat biasing means or other linkages. Finally, a child in the playseat is protected by caps 68 from potential pinch points and due to the mode of folding the seat and the presence of latches 46, there is little likelihood of the child being able to release the seat so that it folds while he is in it.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing be illustrative and not in a limiting sense.

It is also to be understood that the following claims are intended to cover all of the generic and specific features of the invention herein described.

I claim:

1. A child's playseat comprising a base, a generally U-shaped seat-supporting frame member having two legs connected by a bight, means for pivotally connecting the free ends of the legs to the base, a generally U-shaped bail, means for pivotally connecting the opposite ends of the bail to the base below said frame member legs, a pair of telescoping struts having corresponding first ends pivotally connected to the frame member legs intermediate their ends and corresponding second ends pivotally connected to the bail, said bail having a position in overcentered engagement with the base when the seat is erect, means for biasing the struts toward their extended positions so that the bight of the seat-supporting frame member is positioned above the base, and seat structure suspended from the seat-supporting frame member.

2. The playseat defined in claim 1 and further including wheels projecting below the base.

3. The playseat defined in claim 1 and further including a generally U-shaped back frame member and means for pivotally connecting the opposite ends of the back frame member to the opposite legs of the seat-supporting frame member intermediate the ends of those legs.

4. The playseat defined in claim 3 and further including a fabric backrest supported by said back frame member.

5. The playseat defined in claim 3 and further including means enclosing and shielding the pivotal connections between the seat-supporting frame member legs and the back frame member and the struts.

6. The playseat defined in claim 1 wherein each said biasing means comprises a coiled compression spring positioned inside the strut.

7. The playseat defined in claim 1 wherein the legs of the seat-supporting frame member are bent intermediate their ends so that the bight of the frame member and the leg segments adjacent thereto define a substantially horizontal plane above the base.

* * * * *